US006691469B2

(12) United States Patent
Miller

(10) Patent No.: US 6,691,469 B2
(45) Date of Patent: Feb. 17, 2004

(54) FLASHING FOR ROOF PENETRATIONS

(76) Inventor: Joel N. Miller, 129 N. Gentilly, Lafayette, LA (US) 70507

( * ) Notice: Subject to any disclaimer, the term of this patent is extended or adjusted under 35 U.S.C. 154(b) by 46 days.

(21) Appl. No.: 09/782,768

(22) Filed: Feb. 13, 2001

(65) Prior Publication Data

US 2002/0108316 A1 Aug. 15, 2002

(51) Int. Cl.[7] ..... E04D 1/36

(52) U.S. Cl. ..... 52/60; 52/80.2; 52/81.2; 52/220.8; 52/188; 52/199; 52/219; 285/43; 285/42; 285/44

(58) Field of Search ..... 52/80.2, 81.2, 52/220.8, 188, 199, 219; 285/43, 44, 42

(56) References Cited

U.S. PATENT DOCUMENTS

| | | | | | |
|---|---|---|---|---|---|
| 256,060 | A | | 4/1882 | Seagrave et al. | |
| 775,562 | A | | 11/1904 | Golliek | |
| 917,167 | A | * | 4/1909 | Shaw | 285/43 |
| 1,399,748 | A | | 12/1921 | Cheney | |
| 3,363,369 | A | | 1/1968 | Miller | |
| 4,570,396 | A | | 2/1986 | Struben | |
| 5,226,263 | A | * | 7/1993 | Merrin et al. | 285/42 |
| 5,472,241 | A | * | 12/1995 | Kosik et al. | 283/42 |
| 5,970,667 | A | * | 10/1999 | Thaler | 285/42 |

* cited by examiner

*Primary Examiner*—Carl D. Friedman
*Assistant Examiner*—Steve M Varner
(74) *Attorney, Agent, or Firm*—Domingue & Waddell, PLC

(57) ABSTRACT

A flashing for sealing about a roof penetration includes a first sheet having a first edge. The first sheet includes a substantially planar portion and a portion that is inclined with respect to the planar portion. The inclined portion has a recess open at the first edge. A second sheet has a first edge. The second sheet includes a substantially planar portion and a portion that is inclined with respect to the planar portion. The inclined portion has a recess open at the first edge.

5 Claims, 4 Drawing Sheets

FLASHING FOR ROOF PENETRATIONS

BACKGROUND OF THE INVENTION

1. Field of the Invention

The present invention is directed to a flashing for roof penetrations. More specifically, the present invention is directed to a flashing that includes two complimentary mating halves that can be easily placed about an existing roof penetration without requiring removal or disconnection of the penetration, whether it be, for example, a power line or a vent pipes.

2. Discussion of the Related Art

Flashing has been used for decades to weatherproof roof penetrations. The roof penetration may be, for example, a power line or a vent pipe. Conventional flashings for pipes and other roof penetrations are typically made from thin sheet metal that is cut and formed into the desired shape by construction workers at the building site. The flashing is usually formed from one piece of sheet material that has a central opening cut therein to fit about the roof penetration. Thereafter, a sealing material, such as caulk, is placed about the juncture of the roof penetration and the central opening in the sheet material. In many instances, it is desirable to not remove or disconnect the roof penetration, simply because this leads to increased work and sometimes mistakes when replacing or reconnecting the roof penetration, when placing flashing thereabouts. However, when the flashing is made from one piece of sheet material it is often quite difficult, and sometimes impossible, to place the single sheet about the roof penetration. For example, if the rood penetration is a power line, the power company must first be called to disconnect the power line before the flashing can be installed. The power company must then be called after installation to reconnect the power line. This is a great inconvenience and expense to the homeowner.

In addition, conventional flashings are made from essentially planar sheet material throughout so that the portion of the sheet material about the central opening lies in approximately the same plane as the remaining portion of the sheet material. Such a construction leads to increased likelihood of leakage at the central opening. An example of such a conventional flashing is disclosed in U.S. Pat. No. 4,570,396 to Struben which discloses a roof structure of mobile homes. Referring now to FIGS. 10 and 11 of the '396 patent, a flashing arrangement is shown that consists of two essentially planar plates 100, 102. Each plate has a notch to fit around a roof penetration. The plates are placed about the roof penetration and then are affixed in place by fastening means 108, which are affixed to the roof panel 12. A caulking material is then placed about the juncture of the notches in plates 100, 102 and the roof penetration.

Therefore, there is a need in the art for a flashing system for roof penetrations that would not require the removal or disconnection of the penetration prior to installation of the flashing.

SUMMARY OF THE INVENTION

A flashing for sealing about a roof penetration is disclosed. The flashing comprises a first sheet having at least a first edge. The first sheet includes a substantially planar portion and a portion that is inclined with respect to the planar portion, with the inclined portion having a recess open at the first edge. The flashing also includes a second sheet having at least a first edge, with the second sheet comprising a substantially planar portion and a portion that is inclined with respect to the planar portion, with the inclined portion having a recess open at the first edge. The first sheet and second sheet will be conntected together in the most preferred embodiment, with the roof penetration being disposed there through. A U-shaped hem for preventing water from passing over a top side of the respective sheets may also be included.

It is an object of the present invention to provide a flashing that can be placed about a roof penetration without requiring removal or disconnection of the roof penetration.

It is a further object of the present invention to provide a flashing that reduces the likelihood of leakage at the juncture of the roof penetration and an opening in the flashing material.

It is another object of the present invention to provide a flashing that is of relatively simple structure and that may be mass produced at an off-site manufacturing location, economically delivered, and easily and quickly installed by construction personnel to weatherproof openings around roof penetrations of a building.

It is yet another object of the present invention to simplify the installation process by providing a flashing that is made of two pieces of complimentary mating half portions, where each portion is essentially identical so that only one type of flashing sheet material is required to be manufactured.

BRIEF DESCRIPTION OF THE DRAWING FIGURES

The above, as well as other objects of the present invention, will become apparent, and the invention will be better understood, from a detailed description of preferred embodiments thereof, when taken together with accompanying drawings, in which.

DETAILED DESCRIPTION OF THE PRESENTLY PREFERRED EXEMPLARY EMBODIMENTS

Referring now to FIGS. 1–7, a flashing 10 for roof penetrations is illustrated. Flashing 10 includes a first sheet 12 and a second sheet 14. Sheets 12, 14 are preferably made of high-strength sheet metal. First sheet 12 and said second sheet 14 are each preferably made of a one-piece unitary sheet material, such as, for example, stainless steel. In addition, sheets 12, 14 are complimentary mating half portions which, when assembled together form the flashing 10. It should be noted that like numbers appearing in the various figures represent like components.

Figure 4:
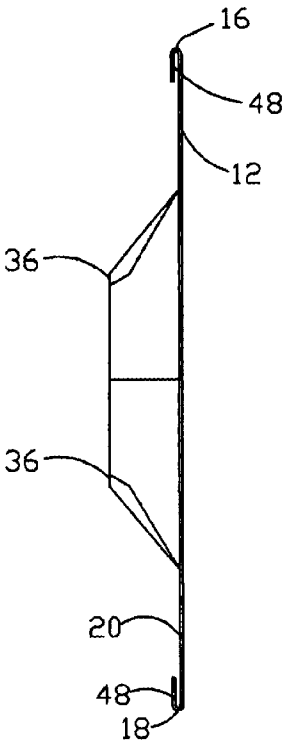
FIG. 4 is a right side view of the sheet of FIG. 2.
Figure 2:
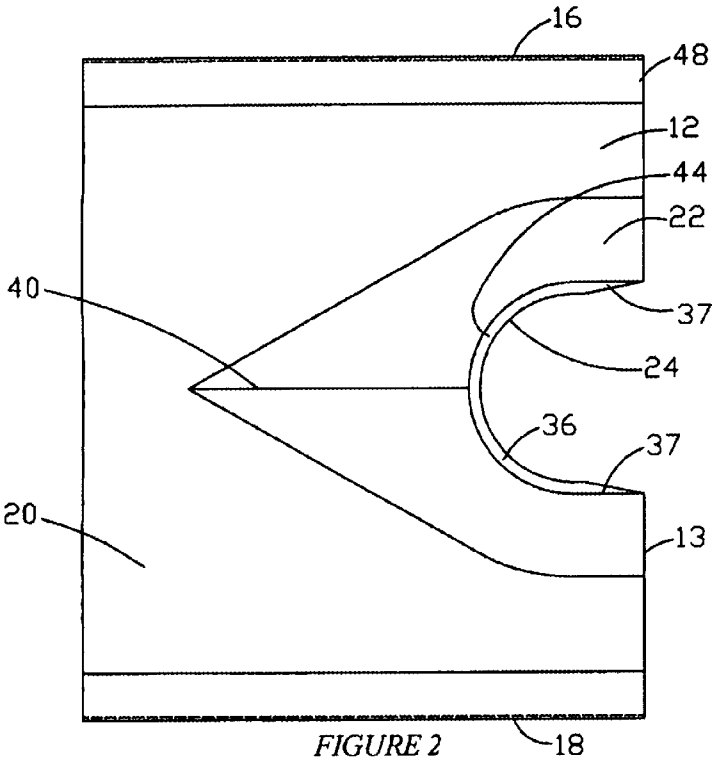
FIG. 2 is a top view of one sheet in accordance with the present invention.
Figure 3:
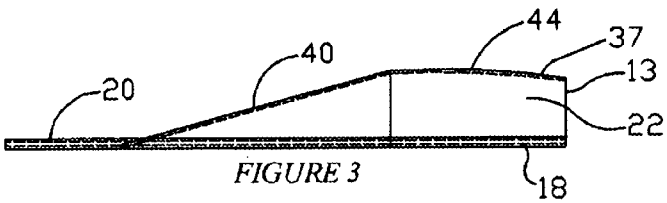
FIG. 3 is a plan view of the sheet of FIG. 2.

Referring now to FIGS. 2–4, first sheet 12 has a first edge 13, a second edge 16 and a third edge 18. First sheet 12 is comprised of a substantially planar portion 20 and a portion 22 that is inclined with respect to the planar portion 20. Inclined portion 22 has a recess 24 open at first edge 13. As shown in FIGS. 3 and 4, the inclined portion 22 is raised relative to the planar surface 20. FIGS. 2, 3 and 4 depict piece A.

Figure 5:
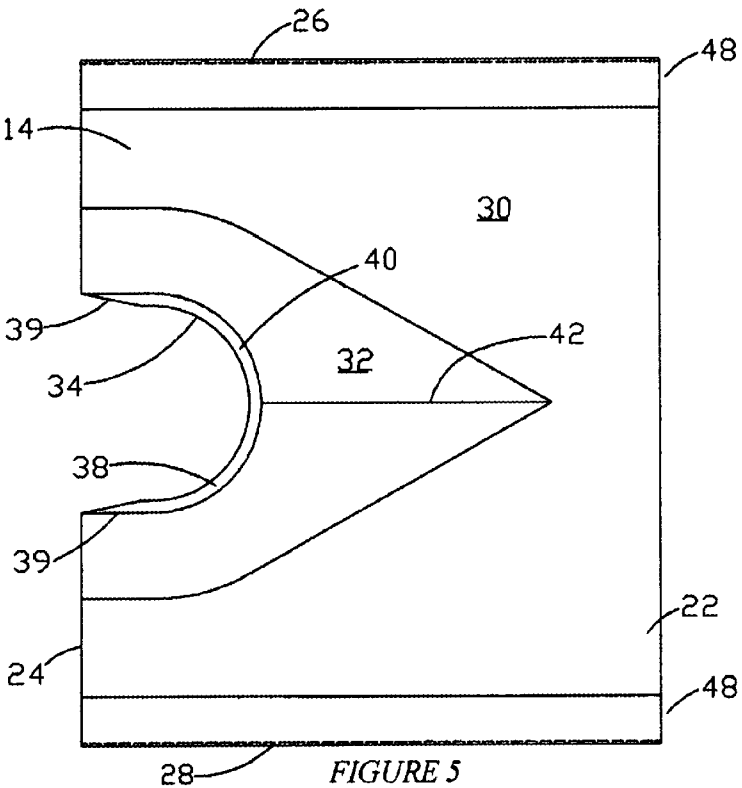
FIG. 5 is a top view of a second sheet in accordance with the present invention.
Figure 6:
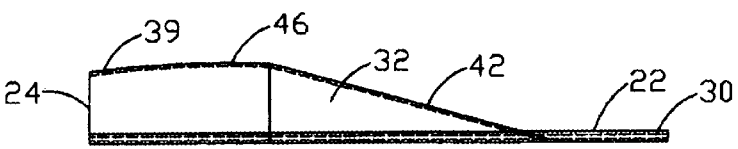
FIG. 6 is a plan view of the sheet of FIG. 5.
Figure 7:
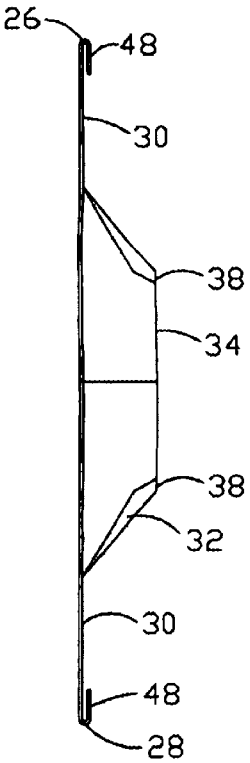
FIG. 7 is a right side view of the sheet of FIG. 5.

Second sheet 14 is substantially identical to first sheet 12 (see FIGS. 5–7). Accordingly, second sheet 14 has a first edge 24, a second edge 26 and a third edge 28. Second sheet 14 is comprised of a substantially planar portion 30 and a portion 32 that is inclined with respect to the planar portion 30. Inclined portion 32 has a recess 34 open at first edge 24. As shown in FIGS. 6 and 7, inclined portion 32 is raised relative to the planar surface 30. FIGS. 5, 6, and 7 depict piece B.

The inclined portion 22, 32 of each of the first sheet 12 and the second sheet 14, respectively, includes a planar rim 36, 38 about recess 22, 32, respectively. Each of the inclined portions includes a peaked ridge 40, 42 extending substantially from the respective planar portion 20, 30 to the respective planar rim 36, 38. Each of the peaked ridges extends approximately linearly. Each of the peaked ridges 40, 42 is disposed approximately perpendicularly with respect to its respective first edge 13, 24.

The planar rims 36, 38 are each substantially U-shaped. The planar rims each include a semicircular portion 44, 46 that is disposed in a first plane that is essentially parallel to a second plane that the respective planar portion 20, 30 is disposed in. The legs 37, 39 of each U-shaped planar rim 36, 38 are each inclined downwardly, back toward the respective planar portion 20, 30.

The second edge 16, 26 and the third edge 18, 28 of the first and second sheets 12, 14 each have a hem 48 for preventing water passing over a top side of the respective sheet. The hem 48 is U-shaped in the preferred embodiment in that the lip of the hem 48 wraps under to an opposite bottom side of the respective sheet. The hems 48 act as a channel and funnel to guide water down to the roof. As illustrated, each of the second edge 16, 26 and said third edge 18, 28 of the first and second sheets 12, 14 are disposed approximately perpendicularly with respect to the respective first edge 13, 24.

Figure 1:
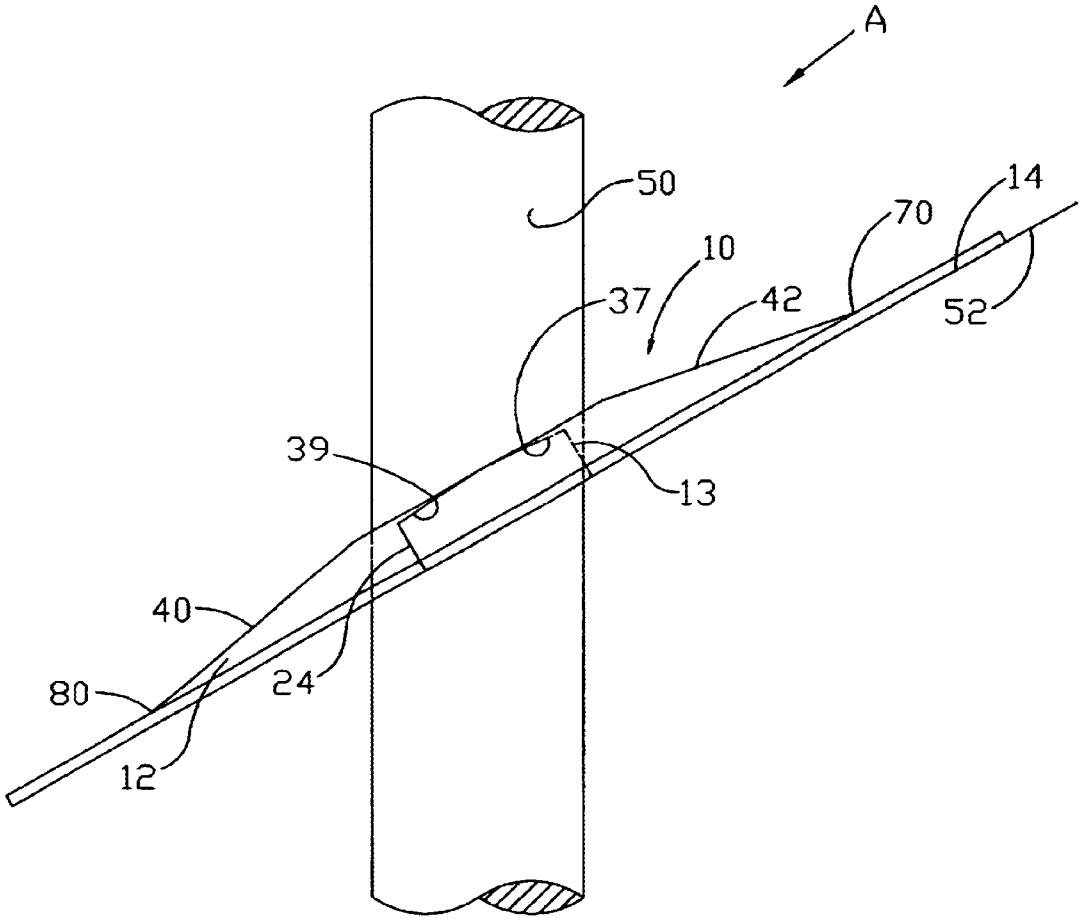
FIG. 1 is a cross-sectional side view of the assembled flashing for roof penetrations in accordance with the present invention.

Referring now to FIG. 1, a roof penetration 50 is illustrated projecting through the roof 52 of a building. Plates 12, 14 are placed about roof penetration 50. The legs 37, 39 of each U-shaped planar rim 36, 38, overlap to ensure a snug fit of the assembled plates 12, 14 about the roof penetration 50. The plates can then be connected to the roof 52 by any conventional manner known to those skilled in the art. A caulking material is then preferably placed about the juncture of the notches in plates 12, 14 and the roof penetration 50. Caulking material is also preferably placed about the juncture of the overlapped plates 12, 14 and the free edges of each plate and the roof, including the outer edges of each water hem 48. The inside edges of each water hem 48 is, therefore, not obstructed to assist in guiding water down the roof.

Once assembled on a roof about a projection 50, peaked ridge 42 helps divert water flowing down on top of second sheet 14 away from the roof projection 50. Inclined portion 32 is preferably a smoothly curved surface extending from the peak ridge 42 down to the planar portion 30 to further assist in diverting water away from the roof projection 50.

Figure 8:
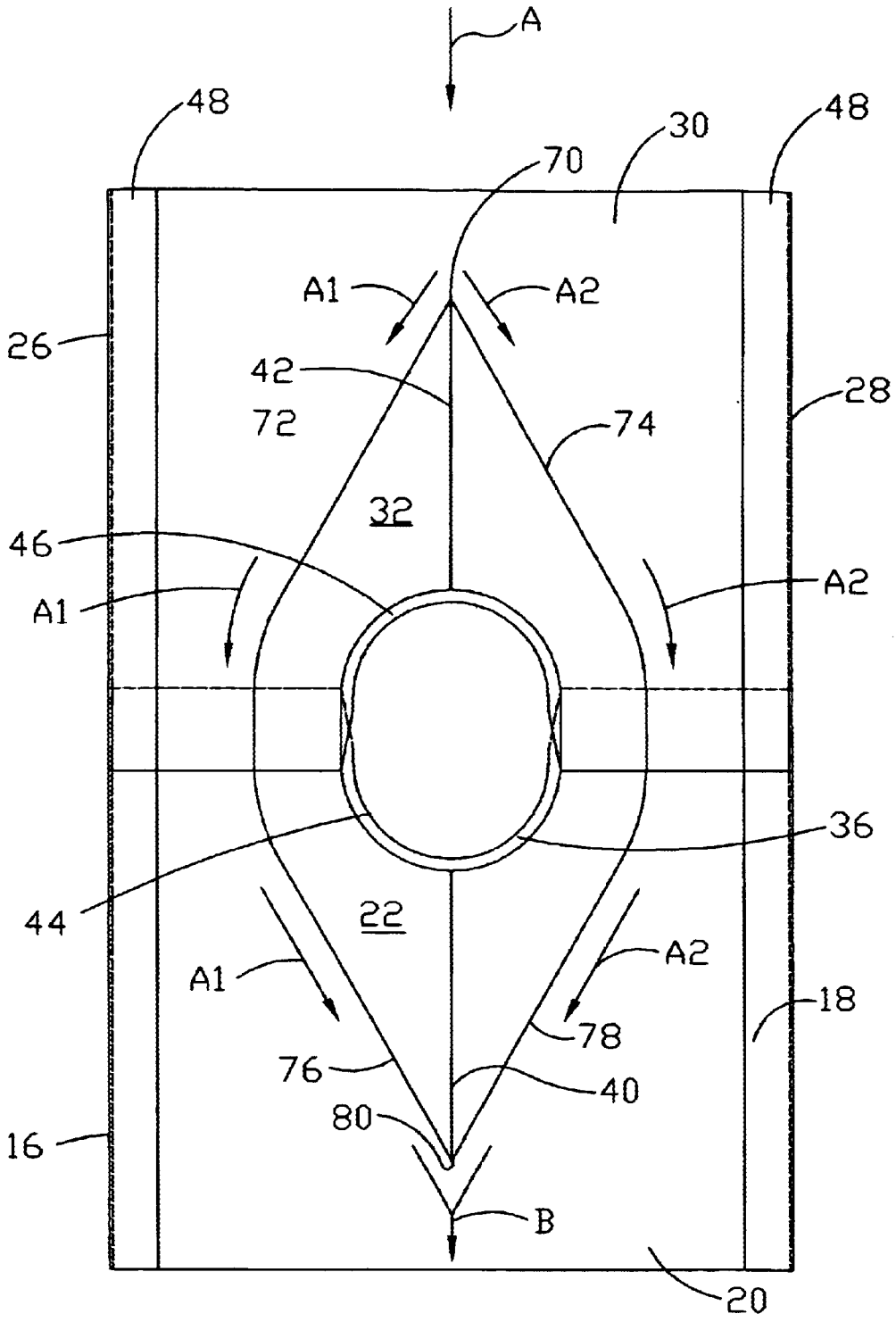
FIG. 8 is a top view of the assembled flashing from FIG. 1.

As seen in FIG. 8, with the unique design of this present invention, water will be diverted about the inclined portion 32, and more specifically, the water will be separated by the peaked ridge 42. Reference is also made to FIG. 1 wherein the water will travel down the roof in the direction as shown by arrow "A" with the least amount of restriction to flow due to the diamond shape of the assembled flashing.

The inclined portion 32, 22 and peaked ridges 42, 40 act as a wedge to split the water flow. However, the splitting of the water flow is done with a minimal amount of resistence to flow and causes a minimal amount of disturbance of the total water flowing down the roof 52.

Additionally, the unique design allows for the water flowing down a roof to separate due to the inclined portion 32 and peaked ridge 42 as well as allowing for the rejoining of the water stream on the bottom side AA of the assembled flashing, namely the inclined portion 22 and peaked ridge 40. Thus, as seen in FIG. 8, water travels down roof 52, strikes the lateral corner 70 of the peaked ridge 42, separates about both sides of the inclined portion 32, namely sides 72, 74. The water flow is denoted by the arrows A1 about one side and A2 about the other side.

The water will continue down along the bottom side AA of the assembled flashing, namely onto the sheet 20 and inclined portion 22. By having the diamond shaped configuration shown in FIG. 8, the flashing acts to join the water stream along sides 76, 78. The sides 76, 78 meet at lateral corner 80 which in turn causes the water stream flowing down the roof 52 to join, as shown by arrow "B". Moreover, the hems 48 acts as a channel to guide water down the roof 52.

Changes and modifications can be made to the invention, as will be readily appreciated by those of ordinary skill in the art, without departing from the spirt and scope of the claims, nor any equivalents therein.

What is claimed is:

1. A method of diverting water flowing down a roof about a roof penetration with a flashing assembly, the flashing assembly comprising a first sheet having a substantially planar portion and a first portion that is inclined with respect to said planar portion; a second sheet having a substantially planar portion and a portion that is inclined with respect to said planar portion, and wherein the first sheet and the second sheet are connected so that the roof penetration is disposed therethrough, wherein the first sheet and said second sheet include a U-shaped hem, and wherein the method comprises:

contacting the water with a first lateral corner formed on said first inclined portion;

diverting the water about a first side and a second side of said first inclined portion;

channeling the water about a third side and a fourth side of said second inclined portion;

joining the water at a second lateral corner formed on said second inclined portion;

preventing the water from passing over the U-shaped hem of said respective first sheet and second sheet;

funneling the water down said second sheet.

2. A flashing for sealing about a roof penetration, said flashing comprising:

a first sheet having at least a first edge, said fisrt sheet comprising a substantially planar portion and a portion that is inclined with respect to said planar portion, said inclined portion having a recess open at said first edge, a second sheet having at least a first edge, said second sheet comprising a substantially planar portion and a portion that is inclined with respect to said planar portion, said inclined portion having a recess open at said first edge; and wherein said first sheet and said second sheet are complimentary mating half portions;

and wherein said first sheet and said second sheet are each made of a one-piece unitary sheet material.

3. The flashing according to claim 2, wherein said first sheet and said second sheet are each made from generally rigid high-strength sheet material.

4. The flashing according to claim 2, wherein said first sheet and said second sheet each include a second edge and a third edge, each having a U-shaped hem for preventing water passing over a top side of said respective sheet.

5. The flashing according to claim 2, wherein each said second edge and said third edge of said first and said second sheet is disposed approximately perpendicular with respect to said respective first edge.

* * * * *